US010155915B2

(12) United States Patent
Tamura

(10) Patent No.: US 10,155,915 B2
(45) Date of Patent: Dec. 18, 2018

(54) LUBRICATING OIL COMPOSITION AND METHOD FOR REDUCING FRICTION IN INTERNAL COMBUSTION ENGINES

(71) Applicant: IDEMITSU KOSAN CO., LTD., Chiyoda-ku (JP)

(72) Inventor: Kazushi Tamura, Kawasaki (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/318,263

(22) PCT Filed: Mar. 30, 2016

(86) PCT No.: PCT/JP2016/060562
§ 371 (c)(1),
(2) Date: Dec. 12, 2016

(87) PCT Pub. No.: WO2016/159185
PCT Pub. Date: Oct. 6, 2016

(65) Prior Publication Data

US 2017/0130158 A1 May 11, 2017

(30) Foreign Application Priority Data

Mar. 31, 2015 (JP) ..... 2015-074378

(51) Int. Cl.

| | |
|---|---|
| ***C10M 141/08*** | (2006.01) |
| ***C10M 129/76*** | (2006.01) |
| ***C10M 129/54*** | (2006.01) |
| ***C10M 135/10*** | (2006.01) |
| ***C10M 163/00*** | (2006.01) |

(52) U.S. Cl.

CPC ..... *C10M 141/08* (2013.01); *C10M 129/54* (2013.01); *C10M 129/76* (2013.01); *C10M 135/10* (2013.01); *C10M 163/00* (2013.01); *C10M 2203/003* (2013.01); *C10M 2203/1025* (2013.01); *C10M 2205/0285* (2013.01); *C10M 2207/026* (2013.01); *C10M 2207/262* (2013.01); *C10M 2207/283* (2013.01); *C10M 2207/289* (2013.01); *C10M 2209/084* (2013.01); *C10M 2215/064* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10N 2210/02* (2013.01); *C10N 2230/02* (2013.01); *C10N 2230/04* (2013.01); *C10N 2230/06* (2013.01); *C10N 2230/08* (2013.01); *C10N 2230/10* (2013.01); *C10N 2230/52* (2013.01); *C10N 2230/54* (2013.01); *C10N 2240/10* (2013.01)

(58) Field of Classification Search

CPC ..... C10M 2219/068; C10M 2219/046; C10M 2207/282
USPC ..... 508/363, 391, 501
See application file for complete search history.

(56) References Cited

U.S. PATENT DOCUMENTS

| | | | | |
|---|---|---|---|---|
| 5,627,146 | A | 5/1997 | Tanaka et al. | |
| 6,245,725 | B1 | 6/2001 | Tanaka et al. | |
| 6,444,624 | B1 * | 9/2002 | Walker | C10M 169/04 508/363 |
| 6,855,675 | B1 | 2/2005 | Yamada et al. | |
| 2006/0068999 | A1 | 3/2006 | Shaw et al. | |
| 2006/0116299 | A1 | 6/2006 | Arrowsmith et al. | |
| 2006/0116300 | A1 | 6/2006 | Arrowsmith et al. | |
| 2010/0069273 | A1 | 3/2010 | Skinner | |
| 2011/0166053 | A1 * | 7/2011 | Yamada | C10M 157/00 508/363 |

FOREIGN PATENT DOCUMENTS

| | | | |
|---|---|---|---|
| JP | 5-279686 | A | 10/1993 |
| JP | 7-150169 | A | 6/1995 |
| JP | 8-176579 | A | 7/1996 |
| JP | 8-209178 | A | 8/1996 |
| JP | 2000-192068 | A | 7/2000 |
| JP | 2001-158897 | A | 6/2001 |
| JP | 2006-152304 | A | 6/2006 |
| JP | 2012-193386 | A | 10/2012 |
| JP | 2015-10177 | A | 1/2015 |
| WO | WO 2013/145759 | A1 | 10/2013 |
| WO | 2015/099820 | | 7/2015 |

OTHER PUBLICATIONS

International Search Report dated Jul. 5, 2016, in PCT/JP2016/060562 filed Mar. 30, 2016.
Extended European Search Report dated Oct. 15, 2018, in the corresponding European patent Application No. 16773066.

* cited by examiner

*Primary Examiner* — Vishal V Vasisth
(74) *Attorney, Agent, or Firm* — Oblon, McClelland, Maier & Neustadt, L.L.P.

(57) ABSTRACT

A lubricating oil composition that hardly generates precipitation attributable to a molybdenum compound under the low temperature environment and is excellent in a friction-reducing effect under the low temperature environment is provided.
The lubricating oil composition is one including (A) a lubricating base oil, (B) a molybdenum-based compound, (C) a metal-based detergent, and (D) an ester compound having one or more hydroxyl groups in a molecule thereof, wherein the metal-based detergent (C) includes (C1) a calcium detergent and (C2) a magnesium detergent, and a content of the ester compound (D) having one or more hydroxyl groups in a molecule thereof is 0.03 to 1.20 mass % on a basis of the total amount of the lubricating oil composition.

8 Claims, No Drawings

LUBRICATING OIL COMPOSITION AND METHOD FOR REDUCING FRICTION IN INTERNAL COMBUSTION ENGINES

TECHNICAL FIELD

This application is a 371 of PCT/JP2016/060562, filed Mar. 30, 2016.

The present invention relates to a lubricating oil composition and a method for reducing friction of an internal combustion engine.

BACKGROUND ART

In recent years, following the strengthening of environmental regulations, high fuel consumption reducing properties have been required for engine oils. For this reason, there have been made efforts for blending a molybdenum compound, such as molybdenum dithiocarbamate (MoDTC), etc., in a lubricating oil composition, thereby reducing a metal-to-metal friction coefficient.

The molybdenum compound, such as MoDTC, etc., exhibits a friction-reducing effect in a relatively high temperature region of 80° C. or higher. Examples of the lubricating oil composition having a molybdenum compound blended therein include those disclosed in PTL 1.

Meanwhile, in order to inhibit the formation of a deposit in the inside of an engine at the time of high-temperature operation and to prevent the accumulation of a sludge, a metal-based detergent, such as a calcium detergent, etc., is added in the lubricating oil composition (see, for example, PTL 2).

CITATION LIST

Patent Literature

PTL 1: JP 2015-010177 A
PTL 2: WO 2013/145759 A

DISCLOSURE OF INVENTION

Technical Problem

But, in the case of adding a metal-based detergent to a lubricating oil composition containing a molybdenum compound, there was involved such a problem that the molybdenum compound is liable to precipitate under the low temperature environment. The formation of a precipitate of the molybdenum compound in the lubricating oil composition not only results in clogging of an oil filter but also impairs the friction-reducing effect based on the molybdenum compound. Therefore, a lubricating oil composition that is stable even under the low temperature environment has been demanded.

An object of the present invention is to provide a lubricating oil composition that hardly generates precipitation attributable to a molybdenum compound under the low temperature environment and is excellent in a friction-reducing effect under the low temperature environment.

Solution to Problem

In order to solve the foregoing problem, an embodiment of the present invention is to provide a lubricating oil composition including (A) a lubricating base oil, (B) a molybdenum-based compound, (C) a metal-based detergent, and (D) an ester compound having one or more hydroxyl groups in a molecule thereof, wherein the metal-based detergent (C) includes (C1) a calcium detergent and (C2) a magnesium detergent, and a content of the ester compound (D) having one or more hydroxyl groups in a molecule thereof is 0.03 to 1.20 mass % on a basis of the total amount of the lubricating oil composition.

Advantageous Effects of Invention

In view of the fact that the lubricating oil composition of the present invention hardly generates precipitation attributable to a molybdenum compound under the low temperature environment, the lubricating oil composition of the present invention is excellent in a friction-reducing effect under the low temperature environment and is able to enhance fuel consumption reducing properties.

DESCRIPTION OF EMBODIMENTS

An embodiment of the present invention is hereunder described.

[Lubricating Oil Composition]

The lubricating oil composition of the present embodiment includes (A) a lubricating base oil, (B) a molybdenum-based compound, (C) a metal-based detergent, and (D) an ester compound having one or more hydroxyl groups in a molecule thereof, wherein the metal-based detergent (C) includes (C1) a calcium detergent and (C2) a magnesium detergent, and a content of the ester compound (D) having one or more hydroxyl groups in a molecule thereof is 0.03 to 1.20 mass % on a basis of the total amount of the lubricating oil composition.

<(A) Lubricating Base Oil>

The lubricating oil composition of the present embodiment includes (A) a lubricating base oil. Examples of the lubricating base oil as the component (A) include a mineral oil and/or a synthetic oil.

Examples of the mineral oil include mineral oils obtained by a usual refining method, such as solvent refining, hydrogenation refining, etc., inclusive of a paraffin base mineral oil, an intermediate base mineral oil, a naphthene base mineral oil, and the like; wax isomerized oils produced by isomerizing a wax, such as a wax produced by the Fischer-Tropsch process (gas-to-liquid wax) or the like, a mineral oil-based wax, etc.; and the like.

Examples of the synthetic oil include a hydrocarbon-based synthetic oil, an ether-based synthetic oil, and the like. Examples of the hydrocarbon-based synthetic oil may include an α-olefin oligomer, such as polybutene, polyisobutylene, a 1-octene oligomer, a 1-decene oligomer, an ethylene-propylene copolymer, etc., or a hydride thereof; an alkylbenzene; an alkylnaphthalene; and the like. Examples of the ether-based synthetic oil include a polyoxyalkylene glycol, a polyphenyl ether, and the like.

Though the lubricating base oil (A) may be of a single system using one selected from the aforementioned mineral oils and synthetic oils, it may also be of a mixed system, for example, a mixture of two or more mineral oils, a mixture of two or more synthetic oils, or a mixture of one or more mineral oils and one or more synthetic oils.

In particular, it is preferred to use one or more selected from mineral oils or synthetic oils classified into Group 3 and Group 4 in the base oil classification of the American Petroleum Institute as the lubricating base oil (A).

A content of the lubricating base oil (A) is preferably 70 mass % or more, more preferably 75 mass % or more and 97 mass % or less, and still more preferably 80 mass % or more and 95 mass % or less on a basis of the total amount of the lubricating oil composition.

<(B) Molybdenum Compound>

The lubricating oil composition of the present embodiment includes (B) a molybdenum compound.

As the molybdenum compound as the component (B), one or more selected from a mononuclear organic molybdenum compound, a binuclear organic molybdenum compound, and a trinuclear organic molybdenum compound can be used. Of those molybdenum compounds, a binuclear organic molybdenum compound is suitable from the viewpoints of low friction properties and corrosion resistance.

Examples of the binuclear organic molybdenum compound include compounds represented by the following general formula (I).

(I)

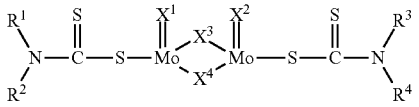

In the general formula (I), each of $R^1$ to $R^4$ represents a hydrocarbon group having 4 to 22 carbon atoms, and $R^1$ to $R^4$ may be the same as or different from each other. When the carbon number is 3 or less, the oil solubility becomes poor; whereas when the carbon number is 23 or more, the melting point becomes high, the handling becomes deteriorated, and the friction-reducing ability becomes low. From the foregoing viewpoints, the carbon number is preferably 4 to 18, and more preferably 8 to 13.

Examples of the hydrocarbon group represented by $R^1$ to $R^4$ include an alkyl group, an alkenyl group, an alkylaryl group, a cycloalkyl group, and a cycloalkenyl group. A branched or linear alkyl group or alkenyl group is preferred, and a branched or linear alkyl group is more preferred. Examples of the branched or linear alkyl group include a n-octyl group, a 2-ethylhexyl group, an isononyl group, a n-decyl group, an isodecyl group, a dodecyl group, a tridecyl group, an isotridecyl group, and the like.

From the viewpoints of solubility in the base oil, storage stability, and friction-reducing ability, in the binuclear organic molybdenum compound represented by the general formula (I), it is preferred that $R^1$ and $R^2$ are the same alkyl group, $R^3$ and $R^4$ are the same alkyl group, and the alkyl groups of $R^1$ and $R^2$ and the alkyl groups of $R^3$ and $R^4$ are different from each other.

In the general formula (I), each of $X^1$ to $X^4$ represents a sulfur atom or an oxygen atom, and $X^1$ to $X^4$ may be the same as or different from each other. A ratio of the sulfur atom and the oxygen atom is preferably 1/3 to 3/1, and more preferably 1.5/2.5 to 3/1 in terms of (sulfur atom)/(oxygen atom). When the ratio falls within the foregoing range, good performances are obtainable in view of corrosion resistance and solubility in the lubricating base oil. All of $X^1$ to $X^4$ may be a sulfur atom or an oxygen atom.

A content of the molybdenum compound (B) as converted into a molybdenum atom is preferably 0.12 mass % or less on a basis of the total amount of the lubricating oil composition. When the content of the molybdenum compound (B) is 0.12 mass % or less, the precipitation of the molybdenum compound can be readily inhibited under the low temperature environment.

From the viewpoint of a balance between inhibition of the precipitation of the molybdenum compound and friction reduction under the low temperature environment, the content of the molybdenum compound (B) as converted into a molybdenum atom is more preferably 0.03 mass % or more and 0.12 mass % or less, and still more preferably 0.06 mass % or more and 0.10 mass % or less on a basis of the total amount of the lubricating oil composition.

<(C) Metal-Based Detergent>

The lubricating oil composition of the present embodiment is required to contain (C) a metal-based detergent and further required to include (C1) a calcium detergent and (C2) a magnesium detergent as the metal-based detergent (C).

The metal-based detergent (C) has actions to inhibit the formation of a deposit in the inside of an engine at the time of high-temperature operation, to prevent the accumulation of a sludge to keep the inside of the engine clean, to neutralize an acidic substance formed as a result of degradation, etc. of an engine oil, and to prevent corrosive wear, and other actions.

As for the aforementioned actions, the calcium detergent is excellent. But, in the case of adding only the calcium detergent to the lubricating oil composition containing a molybdenum compound, even by using (D) an ester compound having one or more hydroxyl groups in a molecule thereof as described later, the precipitation of the molybdenum compound under the low temperature environment cannot be inhibited.

Meanwhile, in the lubricating oil composition of the present embodiment, by using the calcium detergent (C1) and the magnesium detergent (C2) in combination as the metal-based detergent (C) and further using (D) an ester compound having one or more hydroxyl groups in a molecule thereof as described later, it becomes possible to maintain the aforementioned actions of the metal-based detergent (C) and also to inhibit the precipitation of the molybdenum compound under the low temperature environment.

Examples of the calcium detergent (C1) include calcium sulfonate, calcium phenate, and calcium salicylate. Of those, calcium salicylate that is not only excellent in the aforementioned actions of the metal-based detergent but also excellent in fuel consumption reducing properties is suitable.

From the viewpoint of enhancing the aforementioned actions of the metal-based detergent and the like, a total base number of the calcium detergent (C1) is preferably 10 mgKOH/g or more, more preferably 150 to 500 mgKOH/g, still more preferably 150 to 450 mgKOH/g, and yet still more preferably 180 to 400 mgKOH/g.

In the present embodiment, the total base number is one as measured by the perchloric acid method in conformity with JIS K2501.

A content of the calcium detergent (C1) as converted into a calcium atom is preferably 0.20 mass % or less on a basis of the total amount of the lubricating oil composition from the viewpoint that the precipitation of the molybdenum compound is readily inhibited.

In view of a balance between the viewpoint of enhancing the aforementioned actions of the metal-based detergent and the viewpoint of inhibiting the precipitation of the molybdenum compound, the content of the calcium detergent (C1) as converted into a calcium atom is more preferably 0.06 mass % or more and 0.20 mass % or less, still more preferably 0.08 mass % or more and 0.18 mass % or less, and yet still more preferably 0.08 mass % or more and 0.15 mass % or less on a basis of the total amount of the lubricating oil composition.

Examples of the magnesium detergent (C2) include magnesium sulfonate, magnesium phenate, and magnesium salicylate. Among those, from the viewpoint of low friction properties, it is preferred to use one or more selected from magnesium sulfonate and magnesium salicylate, and it is more preferred to use magnesium sulfonate.

From the viewpoint of enhancing the aforementioned actions of the metal-based detergent and the like, a total base number of the magnesium detergent (C2) is preferably 150 mgKOH/g or more, more preferably 150 to 650 mgKOH/g, and still more preferably 200 to 500 mgKOH/g.

A content of the magnesium detergent (C2) as converted into a magnesium atom is preferably 0.12 mass % or less on a basis of the total amount of the lubricating oil composition from the viewpoint of inhibiting a total amount of an ash.

In the case where the content of the magnesium detergent (C2) is small, the amount of the calcium detergent (C1) necessary for regulating the total base number of the lubricating oil composition to a predetermined value or more increases, and the precipitation of the molybdenum compound is hardly inhibited. For this reason, the content of the magnesium detergent as converted into a magnesium atom is more preferably 0.02 mass % or more and 0.12 mass % or less, and still more preferably 0.03 mass % or more and 0.10 mass % or less on a basis of the total amount of the lubricating oil composition.

A mass ratio of the content of the magnesium detergent (C2) as converted into a magnesium atom to the content of the calcium detergent (C1) as converted into a calcium atom [{content of the magnesium detergent (C2) as converted into a magnesium atom}/{content of the calcium detergent (C1) as converted into a calcium atom}] is preferably 0.10 to 0.60, more preferably 0.20 to 0.50, and still more preferably 0.30 to 0.40.

When the calcium detergent (C1) and the magnesium detergent (C2) are used in the aforementioned ratio, not only the aforementioned actions of the metal-based detergent (C) can be maintained, but also the precipitation of the molybdenum compound under the low temperature environment can be readily inhibited.

When the use amount of the magnesium detergent (C2) is large, and the aforementioned mass ratio is more than 0.60, there is a case where an acicular crystal derived from the magnesium detergent or the like is formed to thereby cause gelation depending upon use conditions of the lubricating oil composition.

<(D) Ester Compound>

The lubricating oil composition of the present embodiment is required to include (D) an ester compound having one or more hydroxyl groups in a molecule thereof and to have a content of the ester compound of 0.03 to 1.20 mass % on a basis of the total amount of the lubricating oil composition.

In the present embodiment, there is a case where the terms "(D) an ester compound having one or more hydroxyl groups in a molecule thereof" are called "(D) an ester compound".

In the case where the content of the ester compound (D) relative to the total amount of the lubricating oil composition is less than 0.03 mass %, the precipitation of the molybdenum compound under the low temperature environment cannot be inhibited. In the case where the content of the ester compound (D) relative to the total amount of the lubricating oil composition is more than 1.20 mass %, the detergency is lowered.

The content of the ester compound (D) is preferably 0.03 to 1.00 mass %, more preferably 0.04 to 0.75 mass %, still more preferably 0.04 to 0.60 mass %, and yet still more preferably 0.04 to 0.15 mass % on a basis of the total amount of the lubricating oil composition.

In the ester compound (D), the number of hydroxyl groups in a molecule thereof is preferably 2 or more.

In the ester compound (D), the carbon number is preferably 2 to 24, more preferably 10 to 24, and still more preferably 16 to 22.

Examples of the ester compound having one or more hydroxyl groups in a molecule thereof include an ester compound having one hydroxyl group in a molecule thereof as represented by the following general formula (II) and a compound having two hydroxyl groups in a molecule thereof as represented by the following general formula (III). Of those, a compound represented by the general formula (III) is suitable.

(II)

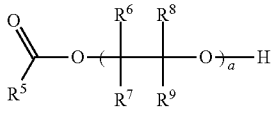

(III)

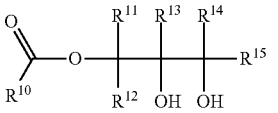

In the general formulae (II) and (III), each of $R^5$ and $R^{10}$ is a hydrocarbon group having 1 to 32 carbon atoms.

The carbon number of the hydrocarbon group represented by $R^5$ and $R^{10}$ is preferably 8 to 32, more preferably 12 to 24, and still more preferably 16 to 20.

Examples of the hydrocarbon group represented by $R^5$ and $R^{10}$ include an alkyl group, an alkenyl group, an alkylaryl group, a cycloalkyl group, and a cycloalkenyl group. Of those, an alkyl group or an alkenyl group is preferred, with an alkenyl group being more preferred.

Examples of the alkyl group represented by $R^5$ and $R^{10}$ include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, and a tetracosyl group. These may be linear, branched, or cyclic.

Examples of the alkenyl group represented by $R^5$ and $R^{10}$ include a vinyl group, a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group, and a tetracosenyl group. These may be linear, branched, or cyclic, and a position of the double bond is arbitrary.

Each of $R^6$ to $R^9$ and $R^{11}$ to $R^{15}$ is a hydrogen atom or a hydrocarbon group having 1 to 18 carbon atoms, and $R^6$ to $R^9$ and $R^{11}$ to $R^{15}$ may be the same as or different from each other.

In the general formula (II), it is preferred that all of $R^6$ to $R^9$ are a hydrogen atom, or all of $R^6$ to $R^8$ are a hydrogen atom, and $R^9$ is a hydrocarbon group. In the general formula (III), it is preferred that all of $R^{11}$ to $R^{15}$ are a hydrogen atom.

In the case where the compound represented by the general formula (II) is used as the ester compound (D), a single kind having the same with respect to each of $R^5$ to $R^9$ may be used, or a mixture of two or more different kinds which are different in a part of $R^5$ to $R^9$ (for example, those in which the carbon number or the presence or absence of a double bond of $R^5$ is different) may be used. Similarly, in the case where the compound represented by the general formula (III) is used as the ester compound (D), a single kind having the same with respect to each of $R^{10}$ to $R^{15}$ may be used, or a mixture of two or more different kinds which are different in a part of $R^{10}$ to $R^{15}$ (for example, those in which the carbon number or the presence or absence of a double bond of $R^{10}$ is different or those which are different with respect to $R^{11}$ to $R^{15}$) may be used.

In the case where $R^6$ to $R^9$ and $R^{11}$ to $R^{15}$ are a hydrocarbon group, the hydrocarbon group may be either saturated or unsaturated, may be either aliphatic or aromatic, and may be linear, branched, or cyclic.

In the general formula (II), though "a" represents an integer of 1 to 20, it is preferably 1 to 12, and more preferably 1 to 10.

The compound represented by the general formula (II) is, for example, a compound obtained through a reaction of a fatty acid and an alkylene oxide.

Here, examples of the fatty acid for obtaining the compound represented by the general formula (II) include lauric acid, myristic acid, palmitic acid, oleic acid, tallow acid, coconut fatty acid, and the like. Examples of the alkylene oxide include alkylene oxides having 2 to 12 carbon atoms, and specific examples thereof include ethylene oxide, propylene oxide, butylene oxide, hexylene oxide, octylene oxide, decylene oxide, dodecylene oxide, and the like.

Examples of the compound represented by the general formula (II) include polyoxyethylene monolaurate, polyoxyethylene monostearate, and polyoxyethylene monooleate.

Examples of the compound represented by the general formula (III) include glycerin fatty acid monoesters, such as glycerin monolaurate, glycerin monostearate, glycerin monomyristate, glycerin monooleate, etc. Of those, glycerin monooleate is suitable.

A ratio of the content of the ester compound (D) and the content of the molybdenum compound (B) as converted into a molybdenum atom [{content of the ester compound (D)}/{content of the molybdenum compound (B) as converted into a molybdenum atom}] is preferably 0.3 to 15.0, more preferably 0.4 to 10.0, still more preferably 0.5 to 7.0, and yet still more preferably 0.5 to 2.5.

When the ester compound (D) and the molybdenum compound (B) are used in the aforementioned ratio, the precipitation of the molybdenum compound under the low temperature environment can be readily inhibited.

<(E) Arbitrary Additive Component>

The lubricating oil composition of the present embodiment may further contain one or more of (E) an arbitrary additive component. Examples of the arbitrary additive component (E) include (E1) a viscosity index improver and (E2) a pour-point depressant. Other examples of the arbitrary additive component (E) include an ashless detergent-dispersant, such as succinimide, a boron-modified succinimide, etc., zinc dithiophosphate, an antioxidant, a rust inhibitor, a metal deactivator, an antifoaming agent, and the like.

Examples of the viscosity index improver as the component (E1) include an olefin-based polymer, such as an ethylene-propylene copolymer, etc., a styrene-based copolymer, such as a styrene-diene hydrogenated copolymer, etc., a poly(meth)acrylate, and the like. Of those, a poly(meth)acrylate is suitable. When the lubricating oil composition of the present embodiment contains the viscosity index improver as the component (E1), the fuel consumption reducing properties can be more improved.

A monomer that constitutes the poly(meth)acrylate is an alkyl (meth)acrylate, and preferably an alkyl (meth)acrylate of a linear alkyl group having 1 to 18 carbon atoms or a branched alkyl group having 3 to 34 carbon atoms.

Examples of the preferable monomer that constitutes the poly(meth)acrylate include methyl (meth)acrylate, ethyl (meth)acrylate, propyl (meth)acrylate, butyl (meth)acrylate, pentyl (meth)acrylate, hexyl (meth)acrylate, heptyl (meth)acrylate, octyl (meth)acrylate, nonyl (meth)acrylate, decyl (meth)acrylate, and the like. Two or more of these monomers may be used to form a copolymer. The alkyl group of such a monomer may be either linear or branched.

A weight average molecular weight (Mw) of the viscosity index improver (E1) is preferably 100,000 to 600,000, more preferably 150,000 to 500,000, still more preferably 320,000 to 500,000, and yet still more preferably 400,000 to 500,000. A number average molecular weight (Mn) of the viscosity index improver (E1) is preferably 10,000 to 1,000,000, and more preferably 30,000 to 500,000. A molecular weight distribution (Mw/Mn) of the viscosity index improver (E1) is preferably 6.0 or less, more preferably 5.0 or less, still more preferably 4.0 or less, and especially preferably 3.5 or less.

In the present embodiment, the "weight average molecular weight" refers to a molecular weight as converted into polystyrene, which is determined by the gel permeation chromatography (GPC) method.

An SSI of the viscosity index improver (E1) is preferably 50 or less, and more preferably 1 to 30. By allowing the weight average molecular weight to fall within the foregoing range, the SSI can be regulated to 30 or less.

Here, the term "SSI" means a shear stability index and expresses an ability of the viscosity index improver to resist decomposition. As the SSI is higher, the polymer is more unstable and decomposed more easily under shear.

$$SSI = \frac{Kv_0 - Kv_1}{Kv_0 - Kv_{oil}} \times 100$$

The SSI is an indication of a decrease in viscosity under shear derived from the polymer and is calculated using the aforementioned calculation formula. In the formula, $Kv_0$ represents a value of kinematic viscosity at 100° C. of a mixture of a base oil and a viscosity index improver added thereto. $Kv_1$ represents a value of kinematic viscosity at 100° C. measured after passing the mixture of a base oil and a viscosity index improver added thereto through a high-shear Bosch diesel injector for 30 cycles according to the procedures of ASTM D6278. $Kv_{oil}$ denotes a value of kinematic viscosity at 100° C. of the base oil. As the base oil, a Group II base oil having a kinematic viscosity at 100° C. of 5.35 $mm^2/s$ and a viscosity index of 105 is used.

From the viewpoint of fuel consumption reducing properties, a content of the viscosity index improver (E1) is preferably 0.01 to 10 mass %, more preferably 0.05 to 5 mass %, and still more preferably 0.05 to 3 mass % on a basis of the total amount of the lubricating oil composition.

Here, the content of the viscosity index improver (E1) means a content of only the resin component of the viscosity index improver and is a content on a solid basis, which does not include, for example, a diluent oil or the like to be contained together with the viscosity index improver.

From the viewpoint of improving the detergency of the lubricating oil composition, a content of the poly(meth) acrylate in the viscosity index improver (E1) that is used in the present invention is preferably 70 to 100 mass %, more preferably 80 to 100 mass %, and still more preferably 90 to 100 mass % relative to the total amount (100 mass %) of the solids in the viscosity index improver (E1).

Examples of the pour-point depressant as the component (E2) include an ethylene-vinyl acetate copolymer, a condensation product of a chlorinated paraffin and naphthalene, a condensation product of a chlorinated paraffin and phenol, a polymethacrylate, a polyalkylstyrene, and the like.

A weight average molecular weight of the pour-point depressant (E2) is preferably 5,000 or more and less than 100,000, and more preferably 25,000 to 75,000. A molecular weight distribution (Mw/Mn) of the pour-point depressant (E2) is preferably 5.0 or less, more preferably 3.0 or less, and still more preferably 2.0 or less.

A content of the pour-point depressant (E2) is preferably 0.01 to 2 mass %, more preferably 0.05 to 1 mass %, and still more preferably 0.1 to 0.5 mass % on a basis of the total amount of the lubricating oil composition.

<Physical Properties of Lubricating Oil Composition>

A total base number of the lubricating oil composition of the present embodiment is preferably 5.0 mgKOH/g or more. By regulating the total base number of the lubricating oil composition to 5.0 mgKOH/g or more, it is possible to inhibit the formation of a deposit in the inside of an engine at the time of high-temperature operation, to prevent the accumulation of a sludge to keep the inside of the engine clean, to neutralize an acidic substance formed as a result of degradation, etc. of an engine oil, and to prevent corrosive wear.

The total base number of the lubricating oil composition is more preferably 5.0 to 15.0 mgKOH/g, still more preferably 7.0 to 12.0 mgKOH/g, and yet still more preferably 8.0 to 10.0 mgKOH/g.

From the viewpoint of friction reduction over a wide temperature range of from a low temperature to a high temperature, it is preferred that the lubricating oil composition of the present invention has a kinematic viscosity at 40° C., a kinematic viscosity at 100° C., and an HTHS viscosity at 150° C. each falling within the following range.

The kinematic viscosity at 40° C. is preferably 20 to 40 $mm^2/s$, and more preferably 20 to 35 $mm^2/s$.

The kinematic viscosity at 100° C. is preferably 3.0 to 12.5 $mm^2/s$, and more preferably 4.0 to 9.3 $mm^2/s$.

The HTHS viscosity at 150° C. is preferably 1.4 to 2.9 mPa·s, and more preferably 1.7 to 2.9 mPa·s.

The kinematic viscosity was measured in conformity with JIS K2283. The HTHS viscosity was measured using a TBS viscometer (tapered bearing simulator viscometer) in conformity with ASTM D4683 under conditions at an oil temperature of 100° C., a shear rate of $10^6$ $sec^{-1}$, a rotational speed (motor) of 3,000 rpm, and a clearance (clearance between a rotor and a stator) of 3 μm.

<Application of Lubricating Oil Composition>

Though the lubricating oil composition of the present embodiment is not particularly limited with respect to its application, it can be suitably used for a variety of internal combustion engines of a four-wheel automobile, a two-wheel automobile, or the like. Among the internal combustion engines, the lubricating oil composition of the present embodiment can be especially suitably used for a gasoline engine.

[Method for Reducing Friction of Internal Combustion Engine]

A method for reducing friction of an internal combustion engine of the present embodiment includes adding the aforementioned lubricating oil composition of the present embodiment to an internal combustion engine.

According to the method for reducing friction of an internal combustion engine of the present embodiment, in view of the fact that the precipitation of the molybdenum compound under the low temperature environment is inhibited, a friction-reducing effect based on the molybdenum compound can be exhibited even under the low temperature environment. In the case where the internal combustion engine is a gasoline engine, the aforementioned effect can be particularly enhanced.

EXAMPLES

Next, the present invention is described in more detail by reference to Examples, but it should be construed that the present invention is by no means limited by these Examples.

1. Preparation of Lubricating Oil Compositions of Examples and Comparative Examples A lubricating oil composition of each of the Examples and Comparative Examples was prepared in a composition shown in Table 1. For preparing the lubricating oil composition, the following materials were used.

<(A) Lubricating Base Oil>

Mineral oil having a kinematic viscosity at 100° C. of 4.07 $mm^2/s$, a viscosity index of 131, a % CA of −0.4, a % CN of 12.8, and a % Cp of 87.6

<(B) Molybdenum Compound>

Binuclear organic molybdenum compound represented by the general formula (I) (MoDTC having an Mo content of 10 mass %)

<(C1) Calcium Detergent>

Overbased calcium salicylate (calcium content: 12.1 mass %, total base number (by the perchloric acid method): 350 mgKOH/g)

<(C2) Magnesium Detergent>

Overbased magnesium sulfonate (magnesium content: 9.4 mass %, total base number (by the perchloric acid method): 410 mgKOH/g, sulfur content: 2.0 mass %)

<(D) Ester Compound>

Glycerin monooleate (number of hydroxyl groups in one molecule: 2)

<(E1) Viscosity Index Improver>

Polymethacrylate-based viscosity index improver (Mw: 480,000, Mw/Mn=2.4, resin content: 21 mass %)

<(E2) Pour-Point Depressant>

Poly-methacrylate-based pour-point depressant (Mw: 50,000, Mw/Mn=1.7, resin content: 66 mass %)

<Other Components>

ZnDTP, hindered phenol-based antioxidant, amine-based antioxidant, polybutenyl succinimide, boron-modified polybutenyl bisimide (boron content: 1.3 mass %, nitrogen content: 1.2 mass %), metal deactivator, and antifoaming agent 2. Measurement and Evaluation Each of the lubricating oil compositions of the Examples and Comparative Examples as prepared in the composition shown in Table 1 was subjected to the following evaluations. The results are shown in Table 1.

2-1. Total Base Number

The total base number of the lubricating oil composition was measured according to the perchloric acid method of JIS K2501.

2-2. Friction Coefficient (MTM Test)

The friction coefficient of the lubricating oil composition was measured under the following conditions.

Tester: MTM (mini traction machine) tester, manufactured by PCS Instruments

Test piece: Standard test piece

Rubbing time: 2 hours

Load: 5 N

Measuring speed: 16 m/s

Temperature: 24° C.

Slide-roll ratio (SRR): 50%

2-3. Low Temperature Stability Test

The state of precipitation on the occasion of allowing the lubricating oil composition in an environment at −5° C. for 5 days and then returning to room temperature (20° C.) was confirmed through visual inspection.

TABLE 1

| | | | Example 1 | Example 2 | Example 3 | Comparative Example 1 | Comparative Example 2 |
|---|---|---|---|---|---|---|---|
| Composition | (A) Lubricating base oil | mass % | Balance | Balance | Balance | Balance | Balance |
| | (B) Molybdenum compound | mass % | 0.90 | 0.90 | 0.90 | 0.90 | 0.90 |
| | (C1) Calcium detergent | mass % | 1.15 | 1.15 | 1.15 | 1.15 | 1.70 |
| | (C2) Magnesium detergent | mass % | 0.54 | 0.54 | 0.54 | 0.54 | — |
| | (D) Ester compound | mass % | 1.00 | 0.50 | 0.05 | — | 0.05 |
| | (E1) Viscosity index improver | mass % | 6.60 | 6.60 | 6.60 | 6.60 | 6.60 |
| | (E2) Pour-point depressant | mass % | 0.20 | 0.20 | 0.20 | 0.20 | 0.20 |
| | Other components | mass % | 8.10 | 8.10 | 8.10 | 8.10 | 8.10 |
| Properties of lubricating oil composition | Molybdenum content derived from (B) | mass % Mo | 0.09 | 0.09 | 0.09 | 0.09 | 0.09 |
| | Calcium content derived from (C1) | mass % Ca | 0.14 | 0.14 | 0.14 | 0.14 | 0.21 |
| | Magnesium content derived from (C2) | mass % Mg | 0.05 | 0.05 | 0.05 | 0.05 | — |
| | Total base number | mgKOH/g | 9.0 | 9.0 | 9.0 | 9.0 | 9.0 |
| Evaluation | Friction coefficient | — | 0.0347 | 0.0368 | 0.0373 | 0.0380 | 0.0391 |
| | Low-temperature stability test | — | Precipitation was not found | Precipitation was not found | Precipitation was not found | Precipitation was found | Precipitation was found |

In Table 1, the term "mass % Mo" expresses a content of the molybdenum compound (B) as converted into a molybdenum atom relative to the total amount of the lubricating oil composition; the term "mass % Ca" expresses a content of the calcium detergent (C1) as converted into a calcium atom relative to the total amount of the lubricating oil composition; and the term "mass % Mg" expresses a content of the magnesium detergent (C2) as converted into a magnesium atom relative to the total amount of the lubricating oil composition.

As is clear from the results shown in Table 1, it can be confirmed that the lubricating oil compositions of Examples 1 to 3 each containing the molybdenum-based compound (B), the calcium detergent (C1), and the magnesium detergent (C2) and further containing an appropriate amount of the ester compound (D) do not generate precipitation of the molybdenum compound even under the low temperature environment at −5° C. For this reason, it can be expected that the lubricating oil compositions of Examples 1 to 3 have a friction-reducing effect equal to that at ordinary temperature (24° C.) even under the low temperature environment at −5° C.

On the other hand, in the lubricating oil composition of Comparative Example 2 in which the total base number was increased by only the calcium detergent (C1) without containing the magnesium detergent (C2) and the lubricating oil composition of Comparative Example 1 not containing the ester compound (D), the molybdenum compound was precipitated under the low temperature environment at −5° C., and thus, a friction-reducing effect equal to that at ordinary temperature (24° C.) could not be expected under the low temperature environment.

2-5. Detergency (Hot Tube Test)

Furthermore, each of the lubricating oil compositions of Examples 1 to 3 and Comparative Example 1 was subjected to a hot tube test at 300° C. by the following method, thereby evaluating the detergency.

The measurement was performed by setting the test temperature to 300° C. and making other conditions in conformity with those of JPI-5S-55-99. Conforming to JPI-5S-55-99, a lacquer attached to a test tube after the test was evaluated between point 0 (black) and point 10 (colorless) and evaluated on 11 grades. It is meant that as the numerical value is higher, the deposits are less formed and the detergency becomes better.

TABLE 2

| | | Example 1 | Example 2 | Example 3 | Comparative Example 1 |
|---|---|---|---|---|---|
| Evaluation | Detergency | 2 | 3 | 5 | 5 |

It can be confirmed from the results shown in Table 2 that though there is a tendency that when the content of the ester compound (D) increases, the detergency is lowered, so long as the content of the ester compound is about 1.00 mass %, the evaluation point is more than the point 0, so that the certain detergency can be ensured.

INDUSTRIAL APPLICABILITY

In view of the fact that the lubricating oil composition of the present embodiment hardly generates precipitation attributable to a molybdenum compound under the low temperature environment, it is excellent in a friction-reducing effect under the low temperature environment and is able to enhance fuel consumption reducing properties. For this reason, the lubricating oil composition of the present embodiment can be suitably used for a variety of internal combustion engines of a four-wheel automobile, a two-wheel automobile, or the like. Among the internal combustion engines, the lubricating oil composition of the present embodiment can be especially suitably used for a gasoline engine.

The invention claimed is:

1. A lubricating oil composition, comprising:

(A) a lubricating base oil comprising mineral oil;

(B) a molybdenum-based compound comprising a binuclear organic molybdenum compound of formula (I):

(I)

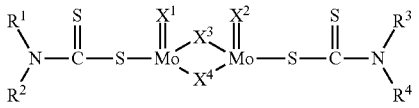

wherein $R^1$ to $R^4$ each represents a hydrocarbon group having 4 to 22 carbon atoms, and $R^1$ to $R^4$ may be the same as or different from each other, and $X^1$ to $X^4$ each represents a sulfur atom or an oxygen atom;

(C) a metal-based detergent comprising (C1) a calcium detergent comprising a calcium salicylate and (C2) a magnesium detergent; and (D) an ester compound of formula (III):

(III)

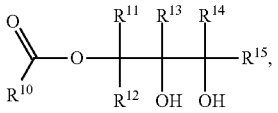

wherein:

$R^{10}$ is a hydrocarbon group having from 12 to 24 carbon atoms; and $R^{11}$ to $R^{15}$ are each a hydrogen atom, wherein a content of the lubricating base oil (A) is 75 mass % or more and 97 mass % or less based on a total amount of the lubricating oil composition, wherein a content of the molybdenum compound (B) as converted into a molybdenum atom is 0.03 mass % or more and 0.12 mass % or less on a basis of the total amount of the lubricating oil composition, wherein a content of the calcium detergent (C1) as converted into a calcium atom is 0.1 mass % or more and 0.20 mass % or less on a basis of the total amount of the lubricating oil composition, wherein a content of the magnesium detergent (C2) as converted into a magnesium atom is 0.02 mass % or more and 0.10 mass % or less on a basis of the total amount of the lubricating oil composition, and wherein a content of the ester compound (D) having one or more hydroxyl groups in a molecule thereof is 0.05 to 1.00 mass % on a basis of the total amount of the lubricating oil composition.

2. The lubricating oil composition according to claim 1, wherein the magnesium detergent (C2) is one or more selected from magnesium sulfonate and magnesium salicylate.

3. The lubricating oil composition according to claim 1, wherein a total base number of the lubricating oil composition is 5.0 mgKOH/g or more.

4. The lubricating oil composition according to claim 1, wherein the lubricating base oil (A) is a mineral oil selected from the group consisting of a paraffin base mineral oil, an intermediate base mineral oil, a naphthene base mineral oil, a wax isomerized oil, and a mineral oil-based wax.

5. The lubricating oil composition according to claim 1 in a form suitable for use in an internal combustion engine.

6. A method for reducing friction of an internal combustion engine, comprising adding the lubricating oil composition according to claim 1 to an internal combustion engine.

7. The lubricating oil composition according to claim 1, wherein a mass ratio of the content of the magnesium detergent (C2) as converted into a magnesium atom to the content of the calcium detergent (C1) as converted into a calcium atom [{content of the magnesium detergent (C2) as converted into a magnesium atom}/{content of the calcium detergent (C1) as converted into a calcium atom}] is 0.10 to 0.60.

8. The lubricating oil composition according to claim 1, further comprising:

(E1) a viscosity index improver having weight average molecular weight 100,000 to 600,000, wherein a content of the viscosity index improver is 1.386 mass % or more and 10 mass % or less based on a total amount of the lubricating oil composition.

* * * * *